US008577265B2

(12) United States Patent
Moon et al.

(10) Patent No.: US 8,577,265 B2
(45) Date of Patent: Nov. 5, 2013

(54) DEVELOPING DEVICE USABLE WITH IMAGE FORMING APPARATUS AND DEVELOPER DELIVERY DEVICE THEREOF INCLUDING A PLURALITY OF ROTATABLE DELIVERY MEMBERS

(75) Inventors: Ji Won Moon, Anyang-si (KR); Ki Jae Do, Suwon (KR); In Cheol Jeon, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 486 days.

(21) Appl. No.: 12/838,650

(22) Filed: Jul. 19, 2010

(65) Prior Publication Data

US 2011/0033208 A1 Feb. 10, 2011

(30) Foreign Application Priority Data

Aug. 6, 2009 (KR) ..... 10-2009-0072270

(51) Int. Cl.
*G03G 15/08* (2006.01)

(52) U.S. Cl.
USPC ..... 399/258

(58) Field of Classification Search
USPC ..... 399/258, 256, 263, 239, 238; 198/314, 198/418.7
See application file for complete search history.

(56) References Cited

U.S. PATENT DOCUMENTS 3,921,578 A * 11/1975 Genthe et al. ..... 399/294
2008/0170898 A1* 7/2008 Shimizu et al. ..... 399/350

FOREIGN PATENT DOCUMENTS

JP 2000-98842 4/2000
KR 10-2008-0061532 7/2008

OTHER PUBLICATIONS

Korean Office Action dated Jan. 27, 2011.

* cited by examiner

*Primary Examiner* — Billy J Lactaoen
(74) *Attorney, Agent, or Firm* — Stanzione & Kim, LLP

(57) ABSTRACT

A developing device usable with an image forming apparatus having a developer delivery device of an improved drive configuration. The developing device includes a developer storage unit, a rotating member arranged in the developer storage unit, and a plurality of developer delivery members arranged in an axial direction of the rotating member to be rotated around the rotating member upon receiving rotation power from the rotating member. A first power-transmission structure may be provided between at least one of the plurality of developer delivery members and the rotating member to allow slip therebetween.

18 Claims, 11 Drawing Sheets

DEVELOPING DEVICE USABLE WITH IMAGE FORMING APPARATUS AND DEVELOPER DELIVERY DEVICE THEREOF INCLUDING A PLURALITY OF ROTATABLE DELIVERY MEMBERS

CROSS-REFERENCE TO RELATED APPLICATIONS

This application claims priority under 35 U.S.C. §119(a) from Korean Patent Application No. 2009-0072270, filed on Aug. 6, 2009 in the Korean Intellectual Property Office, the disclosure of which is incorporated herein in its entirety by reference.

BACKGROUND

1. Field of the Invention

Embodiments of the present general inventive concept relate to a developing device usable with an image forming apparatus having a developer delivery device to deliver developer stored in a developer storage unit.

2. Description of the Related Art

Generally, image forming apparatuses are devised to form an image on a printing medium according to inputted image signals. Examples of image forming apparatuses include printers, copiers, facsimiles, and so-called multi-functional devices that combine some of the functionalities of the aforementioned devices.

An electro-photographic image forming apparatus as a kind of the aforementioned image forming apparatuses includes a photosensitive body, a light scanning device, and a developing device. The light scanning device irradiates light to a surface of a photosensitive body that has been charged by a predetermined electric potential, thereby forming an electrostatic latent image on the surface of the photosensitive body. The developing device supplies developer to the electrostatic latent image, thereby forming a visible image.

The visible image formed on the photosensitive body is directly transferred to the printing medium or is indirectly transferred to the printing medium by way of an intermediate transfer device. The transferred image is fused to the printing medium via a fusing process.

Generally, the developing device includes a developer receiving chamber, a developer delivery device, and a developing member. The developer receiving chamber stores developer therein, and the developer delivery device delivers the developer from the developer receiving chamber to the developing member. The developing member supplies the developer to the photosensitive body, enabling formation of a visible image.

SUMMARY

Exemplary embodiments of the present general inventive concept provide a developing device usable with an image forming apparatus and a developer delivery device thereof having an improved drive configuration to minimize and/or prevent damage to constituent elements.

Additional features and utilities of the present general inventive concept will be set forth in part in the description which follows and, in part, will be obvious from the description, or may be learned by practice of embodiments of the general inventive concept.

Exemplary embodiments of the present general inventive concept may provide a developing device usable with an image forming apparatus includes a developer storage unit, a first rotating member arranged in the developer storage unit, and a plurality of developer delivery members arranged in an axial direction of the first rotating member to be rotated around the first rotating member upon receiving rotation power from the first rotating member.

The developing device may further include a first power-transmission structure to connect at least one of the plurality of developer delivery members and the first rotating member to each other such that there is slip between the at least one of the plurality of developer delivery members and the first rotating member.

The first power-transmission structure may include at least one protrusion to protrude from one of the at least one of the plurality of developer delivery members and the first rotating member, and at least one receiving hole formed in the other one of the at least one of the plurality of developer delivery members and the first rotating member so as to receive the protrusion, and the at least one protrusion may include a slip guide portion formed at a surface thereof to guide the slip between the receiving hole and the protrusion.

The slip guide portion may include at least one of a curved surface and an inclined surface.

The at least one receiving hole may include a contact portion to contact the slip guide portion, and at least one slit extending from an end of the contact portion.

The developing device may further include at least one press member arranged in the developer storage unit to press an outer surface of at least one of the plurality of developer delivery members.

The developing device may further include a second power-transmission structure to connect at least one of the plurality of developer delivery members and the first rotating member to each other such that the at least one of the plurality of developer delivery members is engaged and rotated with the first rotating member.

The plurality of developer delivery members may include a first developer delivery member and a third developer delivery member arranged at opposite sides of the first rotating member in the axial direction, and a second developer delivery member arranged between the first developer delivery member and the third developer delivery member.

At least one of the first developer delivery member and the third developer delivery member may be movable relative to the second developer delivery member.

The developing device may further include a second rotating member arranged opposite the first rotating member to rotatably support the plurality of developer delivery members, and a third power-transmission structure to transmit rotation power of the second developer delivery member to the second rotating member.

The third power-transmission structure may include at least one coupling protrusion to protrude from the second rotating member, and a plurality of coupling holes formed in the second developer delivery member in a rotating direction of the second developer delivery member.

Exemplary embodiments of the present general inventive concept may also provide a developing device usable with an image forming apparatus includes a housing having a developer storage unit defined therein, a first rotating member and a second rotating member arranged in the developer storage unit, and a first, second, and third developer delivery belts arranged in an axial direction of the first rotating member and rotatably supported by the first rotating member and the second rotating member, at least one of the first, second, and third developer delivery belts being rotatable relative to the first rotating member.

The first developer delivery belt and the third developer delivery belt may be arranged at opposite ends of the first rotating member in the axial direction, and may be rotatable relative to the first rotating member.

The second developer delivery belt may be arranged between the first developer delivery belt and the third developer delivery belt and may connect the first rotating member and the second rotating member to each other such that the second rotating member is rotated by the rotation of the first rotating member.

The housing may include at least one press rib protruding inward of the developer storage unit and serving to press an outer surface of at least one of the first to third developer delivery belts.

Exemplary embodiments of the present general inventive concept may also provide a developer delivery device, arranged in a developer storage unit of a developing device usable with an image forming apparatus to deliver developer, includes at least one rotating member arranged in the developer storage unit, a plurality of developer delivery members arranged in an axial direction of the at least one rotating member to be rotated around the at least one rotating member when rotation power is received from the at least one rotating member, a plurality of receiving holes formed in at least one of the plurality of developer delivery members and arranged in a rotating direction of the plurality of developer delivery members, and at least one protrusion to protrude from the at least one rotating member and to be coupled with the plurality of receiving holes to transmit rotation power to the at least one of the plurality of developer delivery members, the at least one protrusion including a slip guide portion formed at a surface thereof to separate the receiving holes from the protrusion according to a load acting on the plurality of developer delivery members.

Exemplary embodiments of the present general inventive concept provide a developing device usable with an image forming apparatus, including a developer storage unit to store developer therein and having a predetermined width, a plurality of developer delivery members adjacent to each other and extending along the predetermined width within the developer storage unit, and a drive member to drive the plurality of developer delivery members to deliver developer along a lengthwise direction of the developed receiving chamber.

The drive member of the developing device can include a first rotating member to rotate the plurality of developer delivery members to deliver the developer, and a second rotating member to support the plurality of developer delivery members and rotate together with the first rotating member.

The developing device can include where the first rotating member and the second rotating member have a plurality of spiral blades to agitate the developer in the receiving chamber.

The developing device can include where the drive member allows slip between at least one of the first and second rotating members and the plurality of developer delivery members.

The developing device can include where the first rotating member and the second rotating member are disposed at different distances from a base frame of the image forming apparatus.

The developing device can include where the plurality of the developer delivery members includes at least one belt.

The developing device can include where the at least one belt is formed from at least one of polyethylene terephthalate (PET) and polycarbonate (PC).

The developing device can include where the drive member allows slip between the at least one belt and the drive member.

The developing device can include where the drive member allows slip between the drive member and the plurality of developer delivery members.

The developing device can include a plurality of protrusions formed on an outer surface of the drive member, and a plurality of receiving holes formed on the plurality of developer delivery members to receive the plurality of protrusions.

The developing device can include wherein at least one of the plurality of protrusions includes a slip guide portion.

The developing device can include wherein the slip guide portion includes a surface that is convexly curved or inclined.

The developing device can include where the plurality of receiving holes have a contact portion to contact at least one of the plurality of developer delivery members that is received, and a slit portion to deform the contact portion when the at least one of the plurality of developer delivery members is received and contacts the contacting portion.

Exemplary embodiments of the present general inventive concept also provide a method of driving a developing device of an image forming apparatus, the method including connecting at least one of a plurality of developer delivery members and a rotating member in a developer storage unit to each other such that there is a slip between the at least one of the plurality of developer deliver members and the rotating member, and rotating the plurality of developer delivery members axially around the rotating member in the developer storage unit when rotation power is received from the rotating member.

Exemplary embodiments of the present general inventive concept also provide a method of driving a developing device of an image forming apparatus, the method including rotating a plurality of developer delivery members axially around a rotating member in a developer storage unit when rotation power is received from the rotating member, and guiding a slip between a protrusion from at least one of the plurality of developer delivery members and the rotating member, and at least one receiving hole formed in another one of the plurality of developer delivery members and the first rotating member.

The method may also include guiding the slip between the receiving hole and the protrusion when a load acting on the plurality of developer delivery members is greater than or equal to a predetermined load value.

An image forming apparatus comprising a developing device, the developing device including a developer storage unit, a first rotating member arranged in the developer storage unit, and a plurality of develop delivery members arranged in an axial direction of the first rotating member to be rotated around the first rotating member upon receiving rotation power from the first rotating member.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
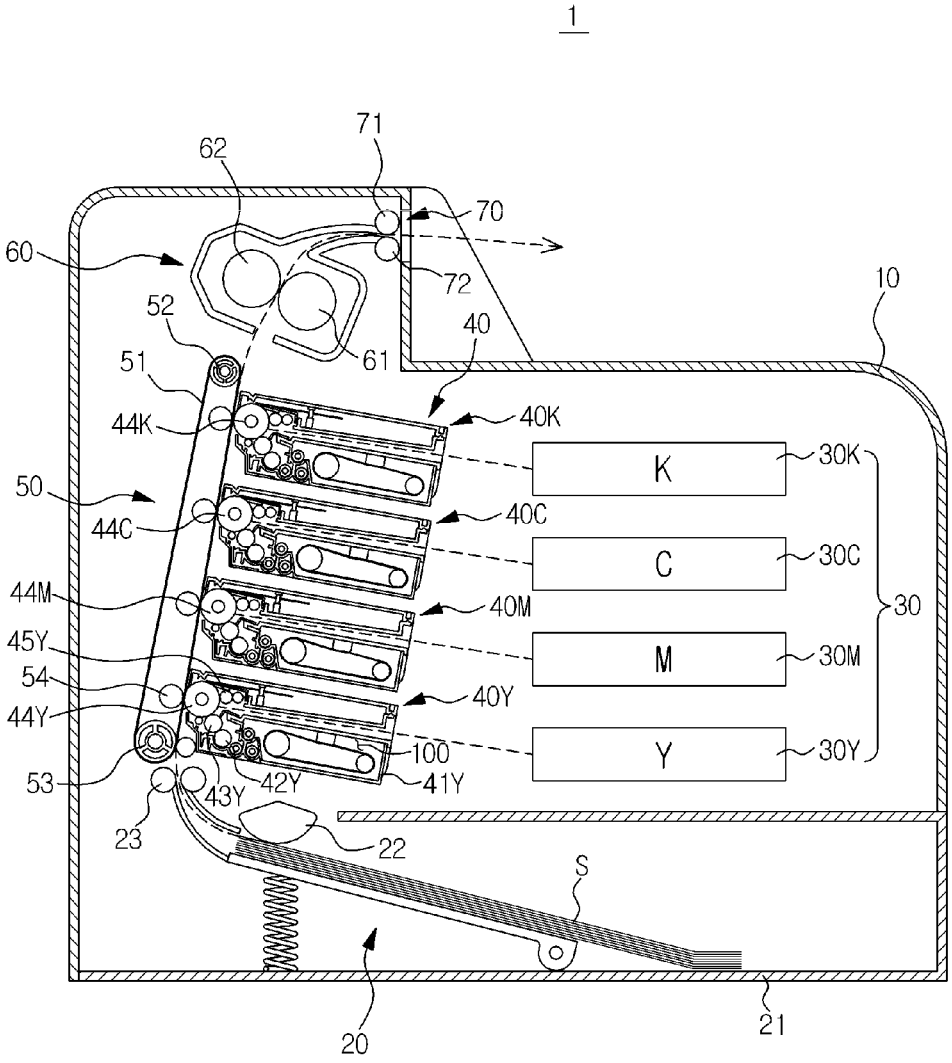
FIG. 1 is a view illustrating a configuration of an image forming apparatus according to exemplary embodiments of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

FIG. 1 is a view illustrating a configuration of an image forming apparatus according to exemplary embodiments of the present general inventive concept.

As illustrated in FIG. 1, the image forming apparatus 1 can include a body 10, a printing medium supply unit 20, a light scanning unit 30, a developing unit 40, a transfer unit 50, a fusing unit 60, and a printing medium discharge unit 70.

The body 10 can define an external appearance of the image forming apparatus 1 and supports a variety of elements mounted therein.

The printing medium supply unit 20 can include a cassette 21 in which printing media S is stored, a pickup roller 22 to pick up the printing media S stored in the cassette 21 sheet by sheet, and delivery rollers 23 to deliver the picked-up printing medium toward the transfer unit 50.

The light scanning unit 30 can include four light scanning devices 30Y, 30M, 30C, and 30K to irradiate light corresponding to Yellow, Magenta, Cyan, and Black image information according to printing signals, to respective photosensitive bodies 44Y, 44M, 44C, and 44K of developing devices 40Y, 40M, 40C, and 40K that will be described hereinafter. Alternatively, the light scanning unit 30 may include light scanning devices that can irradiate light of a different color space, such as Red, Green, and Blue light, which can correspond to image information according to printing signals. With the light irradiated by the four light scanning devices 30Y, 30M, 30C, and 30K, electrostatic latent images can be formed on the respective photosensitive bodies 44Y, 44M, 44C and 44K.

The developing unit 40 can include the four developing devices 40Y, 40M, 40C and 40K, in which different colors of developers, for example, yellow (Y), magenta (M), cyan (C) and black (K) developers are received respectively. Although the developing device 40Y in which a yellow developer (Y) is received will be described hereinafter by way of example, it will be appreciated that the following description is applicable to the other three developing devices 40M, 40C and 40K in which magenta (M), cyan (C) and black (K) developers are received respectively although this is not specially mentioned.

The developing device 40Y can include a housing 41Y, a developer storage unit 100, a developer supply member 42Y, a developing member 43Y, and the photosensitive body 44Y.

The developer storage unit 100 can be defined in the interior of the housing 41Y and stores the developer to be supplied to the photosensitive body 44Y. The developer supply member 42Y can be mounted in the housing 41Y and can supply the developer stored in the developer storage unit 100 to the developing member 43Y. The developing member 43Y can attach the developer to a surface of the photosensitive body 44Y on which an electrostatic latent image has been formed by the light scanning device 30Y, so as to form a visible image. The photosensitive body 44Y can be rotatably coupled to a tip end of the housing 41Y and receives the developer from the developing member 43Y. Although the exemplary embodiments of the present general inventive concept described throughout that the photosensitive body 44Y can be integrally coupled to the developing device 40Y, the photosensitive body 44Y may be separated from the developing device 40Y.

Reference numeral 45Y represents a charging roller to charge the photosensitive body 44Y with a predetermined electric potential before the light scanning device 30 irradiates light to the photosensitive body 44Y.

The transfer unit 50 can transfer the visible image formed on the photosensitive body 44Y to the printing medium. The transfer unit 50 can include a printing medium delivery belt 51, a driving roller 52, a driven roller 53, and a plurality of transfer rollers 54.

The printing medium delivery belt 51 can deliver the printing medium supplied from the printing medium supply unit 20 to each of the plurality of photosensitive bodies 44Y, 44M, 44C, and 44K.

The driving roller 52 and the driven roller 53 can bearranged inside the printing medium delivery belt 51 at opposite ends thereof, and can act to rotate the printing medium delivery belt 51 in an endless orbit.

The plurality of transfer rollers 54 can be arranged opposite the respective photosensitive bodies 44Y, 44M, 44C and 44K with the printing medium delivery belt 51 interposed therebetween, so that the visible image formed on each of the photosensitive bodies 44Y, 44M, 44C and 44K can be transferred to the printing medium delivered by the printing medium delivery belt 51.

The fusing unit 60 can include a heating roller 61 having a heating source, and a press roller 62 arranged opposite the heating roller 61. When the printing medium passes between the heating roller 61 and the press roller 62, the transferred image can be fused to the printing medium by heat conducted from the heating roller 61 and pressure acting between the heating roller 61 and the press roller 62.

The printing medium discharge unit 70 can include a paper discharge roller 71 and a paper backup roller 72 and discharges the printing medium, having passed through the fusing unit 60, out of the body 10.

Figure 2:
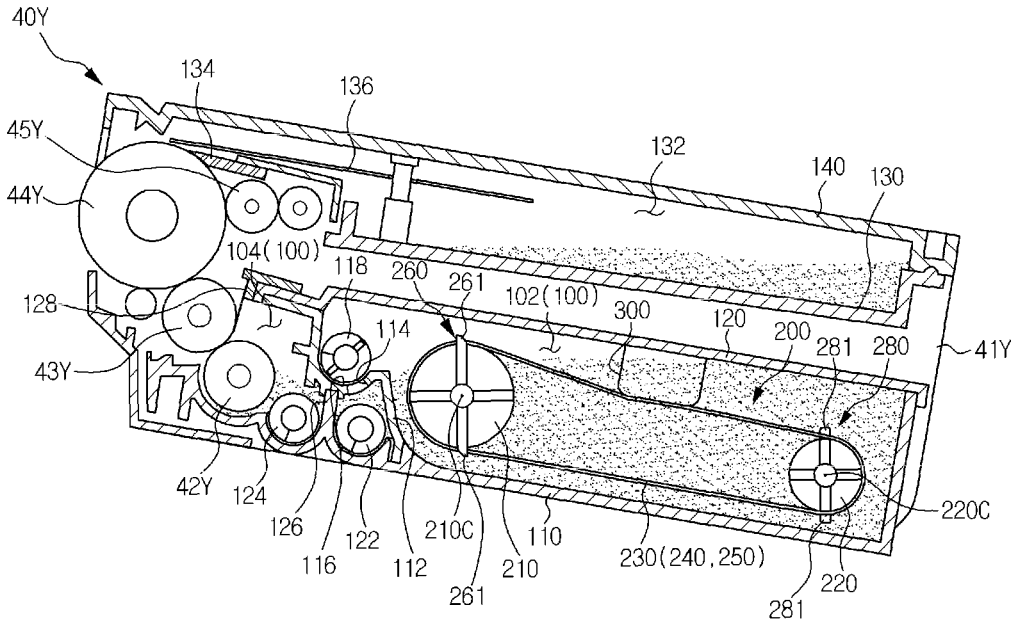
FIG. 2 is a sectional view illustrating a developing device according to exemplary embodiments of the present general inventive concept.
Figure 3:
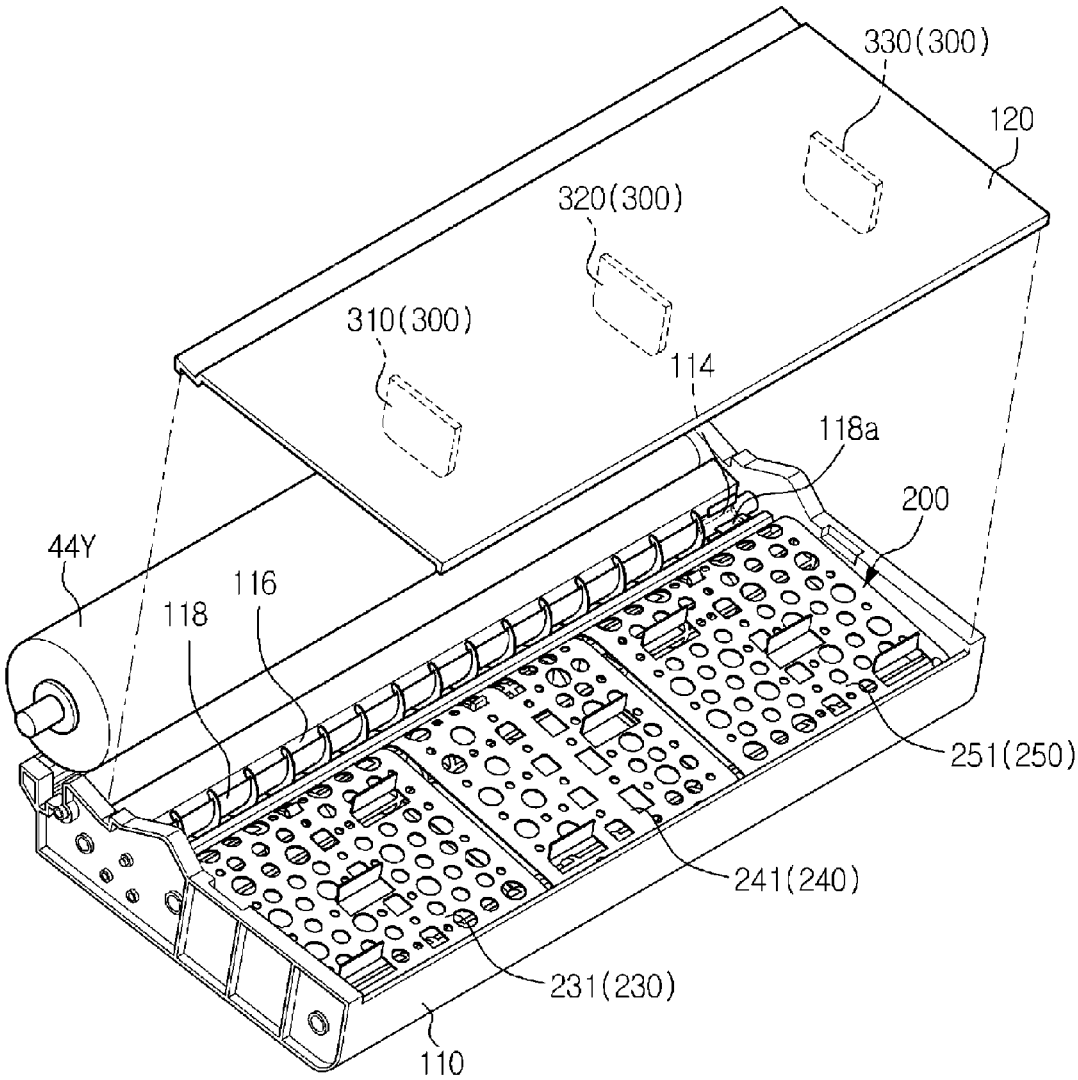
FIG. 3 is a perspective view illustrating constituent elements illustrated in FIG. 2.

FIG. 2 is a sectional view illustrating the developing device according to example embodiments of the present general inventive concept, and FIG. 3 is a perspective view illustrating one or more constituent elements illustrated in FIG. 2.

As illustrated in FIGS. 2 and 3, the housing 41Y can include a base frame 110, a cover 120, an upper frame 130, and an upper cover 140.

The base frame 110 can support a variety of elements received therein. The cover 120 can cover a top of the base frame 110 and can be coupled with the base frame 110 to define the developer storage unit 100 for storage of the developer together.

The upper frame 130 and the upper cover 140 can be arranged above the cover 120 and can define a waste developer storage unit 132 to store waste developer that can be collected from the photosensitive body 44Y.

The upper frame 130 ican be provided with a cleaning member 134. The cleaning member 134 can scrape the developer remaining on the surface of the photosensitive member 44Y. The waste developer removed by the cleaning member 134 can be delivered by a waste developer delivery member 136 and can be stored in the waste developer storage unit 132.

The waste developer delivery member 136 can be arranged above the cleaning member 134. The waste developer delivery member 136 may have a plate shape and may be formed of a plastic molded product or a film having high restoration elasticity. The plate-shaped waste developer delivery member 136 may reduce a height of the developing device 40Y, and efficient delivery of waste developer can be increased, even if a height of the waste developer storage unit 132 is reduced.

The waste developer storage unit 100 can be divided into a first developer storage unit 102 and a second developer storage unit 104 by a partition 112. The first developer storage unit 102 and the second developer storage unit 104 can vertically communicate with each other through an inlet hole 114 perforated in the partition 112.

A developer delivery device 200 can be arranged in the first developer storage unit 102. The developer delivery device 200 can deliver a part of the developer stored in the first developer storage unit 102 toward the second developer storage unit 104. In addition to performing delivery of the developer, the developer delivery device 200 can agitate the developer inside the first developer storage unit 102.

The developer stored in the first developer storage unit 102 can be delivered upward by the developer delivery device 200 to supply a developer seat 116 defined on the partition 112. The developer supplied to the developer seat 116 can be moved to an end of the partition 112 by a supply auger 118 and thereafter, can fall into the second developer storage unit 104 through the inlet hole 114.

A first circulation auger 122, a second circulation auger 124, and the developer supply member 42Y, and the developing member 43Y can be arranged in the second developer storage unit 104.

The developer, fallen from the inlet hole 114 of the partition 112, can be circulated by the first circulation auger 122 and the second circulating auger 124 between which a circulation wall 126 can be interposed. The developer can be supplied to the developing member 43Y by the developer supply member 42Y. The developer supplied to the developing member 43Y can define a layer of developer and the developer layer is leveled by a regulator 128. As the developer layer can be attached to the surface of the photosensitive body 44Y on which the electrostatic latent image has been formed by the light scanning device 30Y, formation of a visible image can be accomplished.

The supply auger 118, the first circulation auger 122, the second circulation auger 124, the developer supply member 42Y, and the developing member 43Y illustrated in FIG. 2 exemplify constituent elements to supply the developer to the photosensitive body 44Y, and the developer supply elements are not limited to the aforementioned ones. For example, the developer supply member 42Y may be omitted in a binary developing type. Although FIG. 2 illustrates the developer supply member 42Y or the developing member 43Y in the form of a cylindrical roller, the shape of these members is not limited to the roller shape, and the members 42Y and 43Y may be a belt type or a brush type. The auger type delivery members 118, 122 and 124 illustrated in FIG. 2 may be replaced by other shapes and/or types of delivery members suitable to carry out the exemplary embodiments of the present general inventive concept described throughout.

After developer is supplied into the second developer storage unit 104 (e.g., a sufficient amount of developer to carry out the exemplary embodiments of the present general inventive concept described herein), the developer is not introduced through the inlet hole 114, and can be returned to the developer delivery device 200 by a return blade 118*a* provided at an end of the supply auger 118 at a position corresponding to the inlet hole 114.

Figure 4:
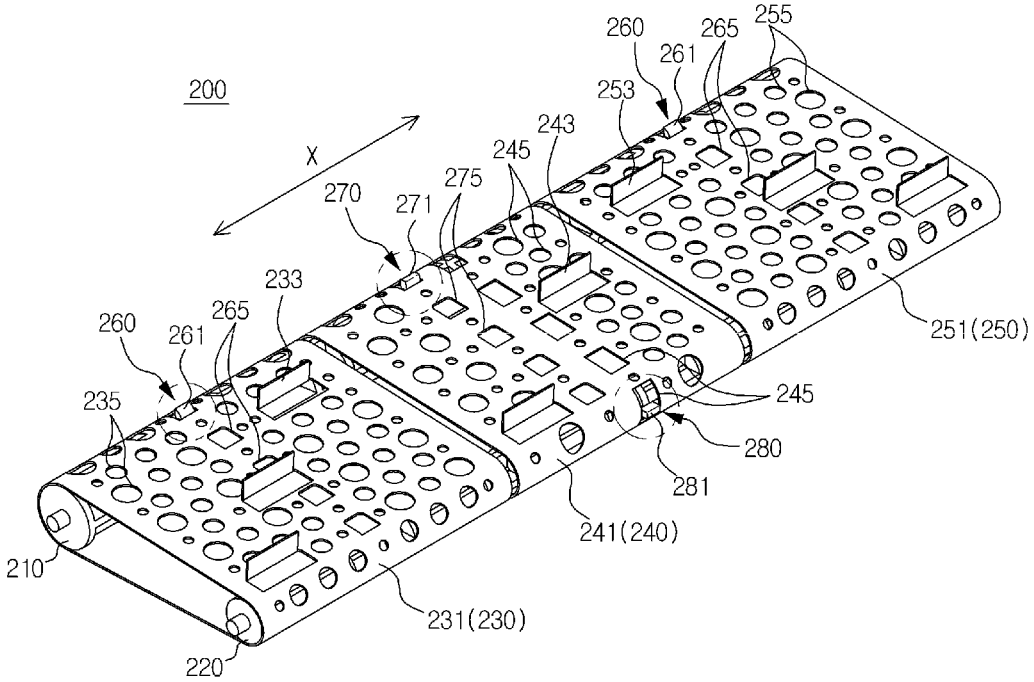
FIG. 4 is a perspective view illustrating a developer delivery device according to exemplary embodiments of the present general inventive concept.

FIG. 4 is a perspective view illustrating the developer delivery device according to exemplary embodiments of the present general inventive concept.

As illustrated in FIGS. 2 and 4, the developer delivery device 200 can include a first rotating member 210, a second rotating member 220, and a plurality of developer delivery members 230, 240, and 250. The first rotating member 210 and the second rotating member 220 can rotatably support the developer delivery members 230, 240 and 250. The developer delivery members 230, 240 and 250 can be rotated around the first rotating member 210 and the second rotating member 220 and can deliver the developer stored in the first developer storage unit 102 to the top of the partition 112.

The first rotating member 210 can be positioned in the first developer storage unit 102 at a position adjacent to the partition 112. The second rotating member 220 can be arranged opposite the first rotating member 210 with a predetermined distance therebetween.

The first rotating member 210 can be rotated upon receiving power from a motor (not illustrated) mounted in the body 10 and can support one side of inner surfaces of the developer delivery members 230, 240 and 250 to transmit rotation power to the developer delivery members 230, 240 and 250. The second rotating member 220 can support the other side of the inner surfaces of the developer delivery members 230, 240 and 250 and can be rotated together with the developer delivery members 230, 240 and 250.

The first rotating member 210 and the second rotating member 220 may include a spiral blade structure or any other suitable blade structure to carry out the exemplary embodiments of the present general inventive concept to agitate the developer stored in the first developer storage unit 102.

A rotation center 210C of the first rotating member 210 may be located higher than a rotation center 220C of the second rotating member 220. Specifically, the rotation center 210C of the first rotating member 210 may be positioned farther from the bottom of the base frame 110 than the rotation center 220C of the second rotating member 220. This configuration may minimize and/or prevent the developer from being moved from the first developer storage unit 102 to the second developer storage unit 104 by a weight thereof, and may allow the developer to be supplied by delivery force of the developer delivery members 230, 240 and 250. This may control the supply amount of the developer.

The developer delivery members 230, 240 and 250 may be belts or any other suitable members to carry out the exemplary embodiments of the present general inventive concept as described herein. Features and utilities of the belt type developer delivery members are described in detail below.

Conventionally, a plurality of agitators is arranged in a developer delivery direction to supply developer toward the developer supply member. In a color image forming apparatus of the exemplary embodiments of the present general inventive concept as illustrated in FIG. 1 wherein the plurality of developing devices may be vertically stacked one above another, a stack height of one or more developing devices may be reduced so as to reduce the height of the image forming apparatus. This may reduce a rotation radius of the agitator arranged in the developing device. However, the smaller the rotation radius of the agitator, the smaller the rotation radius of the developer being delivered and thus, the smaller the delivery area of the developer. Accordingly, one or more agitators may be included to deliver the developer with increased efficiency. However, when the developer is supplied by passing through a great number of agitators, the developer may be increasingly stressed. Also, the increased number of the agitators may increase the complication of the configuration of the developing device, and, consequently, may increase the complication of a power-transmission structure to drive the agitators.

When using the belt type developer delivery members, it may be unnecessary to provide the plurality of agitators even if the height of the developing device is reduced, thus increasing the simplification of a power-transmission structure. This may also minimize and/or reduce stress applied to the developer.

Developer delivery belts 231, 241 and 251 may be and/or include a film having a thickness of about 2 mm or less, and may be made of polyethylene terephthalate (PET), polycarbonate (PC), etc.

The developer received in the first developer storage unit 102 may be lopsided in an axial direction X of the first rotating member 210, thereby being clumped during conveyance or handling of the developing device 40Y. The clumped developer may minimize and/or prevent motion of the developer delivery device 200, raising an initial drive torque r to rotate the developer delivery device 200. An increased load may be applied to the first rotating member 210 that may damage the first rotating member 210 or damage the gears that transmit power to the first rotating member 210.

To minimize and/or prevent damage to the first rotating member 210, as illustrated in FIG. 4, exemplary embodiment of the present general inventive concept can include the plurality of developer delivery belts 231, 241 and 251 arranged in the axial direction X of the first rotating member 210. When the developer delivery device 200 may be overloaded due to, among other things, the clumped developer, at least one of the plurality of developer delivery belts 231, 241 and 251 may be operationally minimized and/or prevented from operating, and this may minimize and/or prevent deformation of or damage to the first rotating member 210.

The plurality of developer delivery belts may include first to third developer delivery belts 231, 241 and 251. The first developer delivery belt 231 and the third developer delivery belt 251 may be located respectively at opposite ends of the first rotating member 210 in the axial direction X of the first rotating member 210, and the second developer delivery belt 241 may be located between the first developer delivery belt 231 and the third developer delivery belt 251.

The first developer delivery belt 231 can be connected to one end of the first rotating member 210 via a first power-transmission structure 260, so as to be movable relative to the first rotating member 210. The first power-transmission structure 260 can connect the first developer delivery belt 231 to the first rotating member 210, to allow slip between the first developer delivery belt 231 and the rotating member 210.

Figure 5:
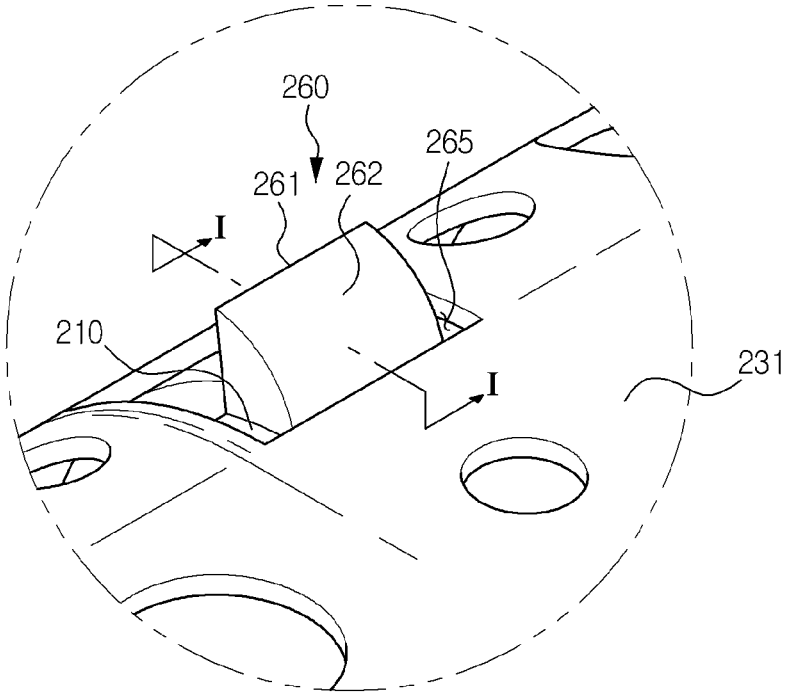
FIG. 5 is an enlarged view illustrating a first power-transmission structure illustrated in FIG. 4.
Figure 6:
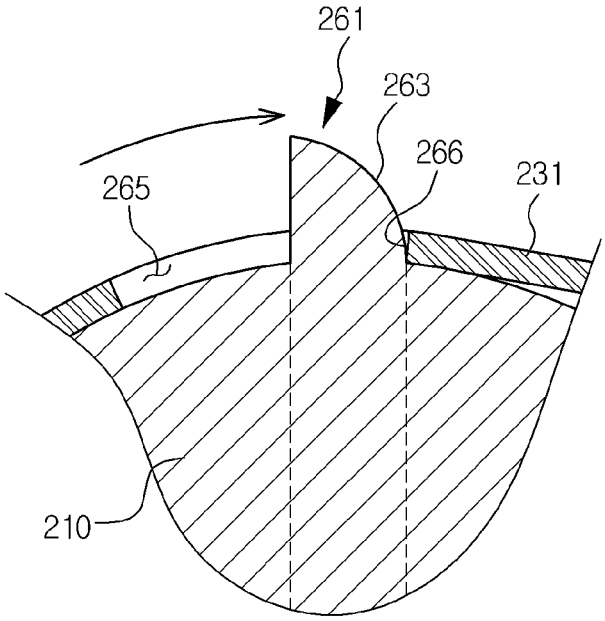
FIG. 6 is a sectional view taken along the line I-I of FIG. 5.

FIG. 5 is an enlarged view illustrating the first power-transmission structure illustrated in FIG. 4, and FIG. 6 illustrates a sectional view taken along the line I-I of FIG. 5.

As illustrated in FIGS. 4 to 6, the first power-transmission structure 260 may include a plurality of protrusions 261 formed at an outer peripheral surface of the first rotating member 210, and a plurality of receiving holes 265 formed in the first developer delivery belt 231 to receive the plurality of protrusions 261. The plurality of protrusions 261 can be arranged in a circumferential direction of the first rotating member 210, and the plurality of receiving holes 265 is arranged in a rotating direction of the first developer delivery belt 231.

The protrusions 261 of the first rotating member 210 are inserted into the receiving holes 265 as the first rotating member 210 is rotated, serving to transmit rotation power to the first developer delivery belt 231. The protrusions 261 may be configured to be separated from the receiving holes 265 when great load acts on the first developer delivery belt 231.

One or more of the receiving holes 265 can have a contact portion 266 to come into contact with the protrusion 261 inserted thereinto, and one or more of the protrusions 261 can have a slip guide portion 262 formed at a surface thereof opposite the contact portion 266 of the receiving hole 265 to guide slip between the receiving hole 265 and the protrusion 261.

As illustrated in FIGS. 5 and 6, the slip guide portion 262 of the protrusion 261 may have a convexly curved surface 263. The convexly curved surface 263 can minimize and/or prevent the protrusion 261 from being from the receiving hole 265. On the other hand, when great load is applied between the slip guide portion 262 and the contact portion 266, the convexly curved surface 263 allows the contact portion 266 to effectively slip on the slip guide portion 262.

Figure 7:
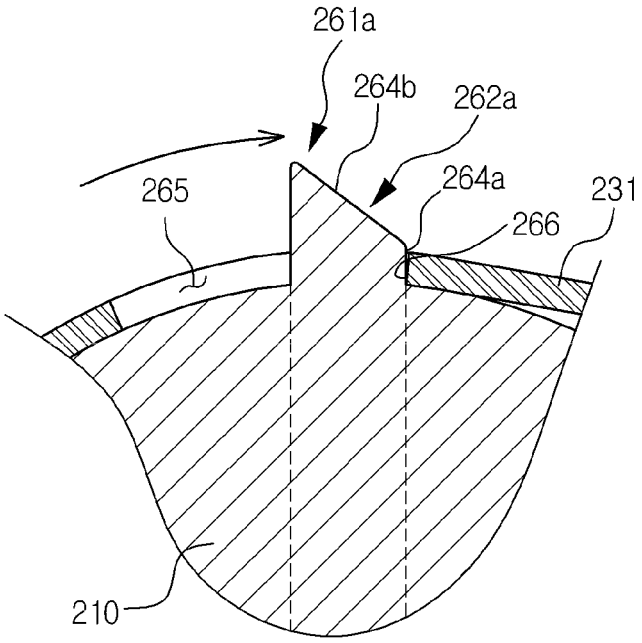
FIG. 7 is a view illustrating exemplary embodiments of the present general inventive concept of a protrusion.

FIG. 7 is a view illustrating the protrusion according to exemplary embodiments of the present general inventive concept. As illustrated in FIG. 7, a slip guide portion 262*a* of a protrusion 261*a* may include a holding surface 264*a* extending radially from the outer peripheral surface of the first rotating member 210 and an inclined surface 264*b* extending obliquely from the holding surface 264*a*.

The holding surface 264*a* of the protrusion 261*a* can have a height to allow the protrusion 261*a* to be separated from the receiving hole 265 of the first developer delivery belt 231 when a load greater than or equal to a predetermined value is applied between the protrusion 261*a* and the receiving hole 265 while minimizing and/or preventing the protrusion 261 from being separated from the receiving hole 265 at normal times (e.g., at times when the applied load is less that the predetermined value, when a load is not applied, etc.).

The inclined surface 264*b* can be inclined upward away from the contact portion 266 of the receiving hole 265, guiding the separation of the protrusion 261*a* from the receiving hole 265.

Figure 8:
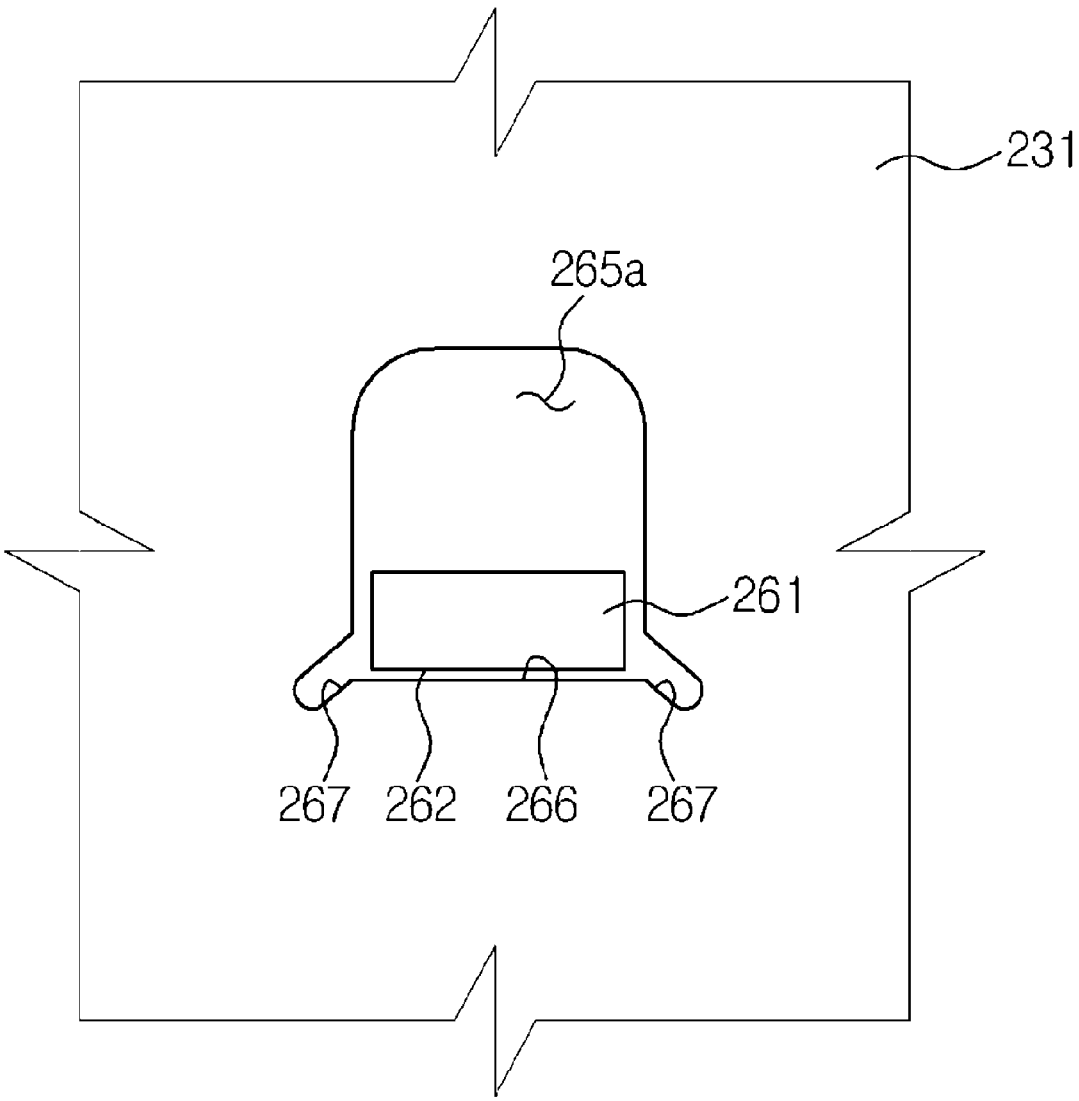
FIG. 8 is a plan view illustrating exemplary embodiments of the present general inventive concept of a receiving hole.

FIG. 8 is a plan view illustrating a receiving hole according to exemplary embodiments of the present general inventive concept. As illustrated in FIG. 8, a receiving hole 265*a* of the first developer delivery belt 231 may have a slit 267 extending from either end of the contact portion 266. A side of the receiving hole 265*a* opposite to the slip guide portion 262 of the protrusion 261 can have an increased length such that the contact portion 266 can be deformed and allow the protrusion 261 to increase the smoothness of separation from the receiving hole 265*a*.

Although FIG. 2 illustrates an example wherein two protrusions 261 are used, the number of the protrusions is not limited thereto, and one protrusion, three protrusions, or any other suitable number of protrusions to carry out the exemplary embodiments of the present general inventive concept described herein may be used.

Although FIG. 5 illustrates an example wherein the first rotating member 210 is formed with the protrusions 261 and the first developer delivery belt 231 is formed with the holes 265, the first developer delivery belt may be formed with the protrusions and the first rotating member may be formed with the holes or recesses.

As illustrated in FIG. 4, the third developer delivery belt 251 can be connected to the other end of the first rotating member 210, so as to be movable relative to the first rotating member 210. The third developer delivery belt 251 may be connected to the first rotating member 210 via the first power-transmission structure 260 as illustrated in FIGS. 5 to 8, similar to the first developer delivery belt 231.

The second developer delivery belt 241 between the first developer delivery belt 231 and the third developer delivery belt 251 can be connected to the first rotating member 210 via a second power-transmission structure 270. The second power-transmission structure 270 allows the second developer delivery belt 241 to be rotatably engaged with the first rotating member 210, but may minimize and/or prevent the second developer delivery belt 241 from moving relative to the first rotating member 210.

Figure 9:
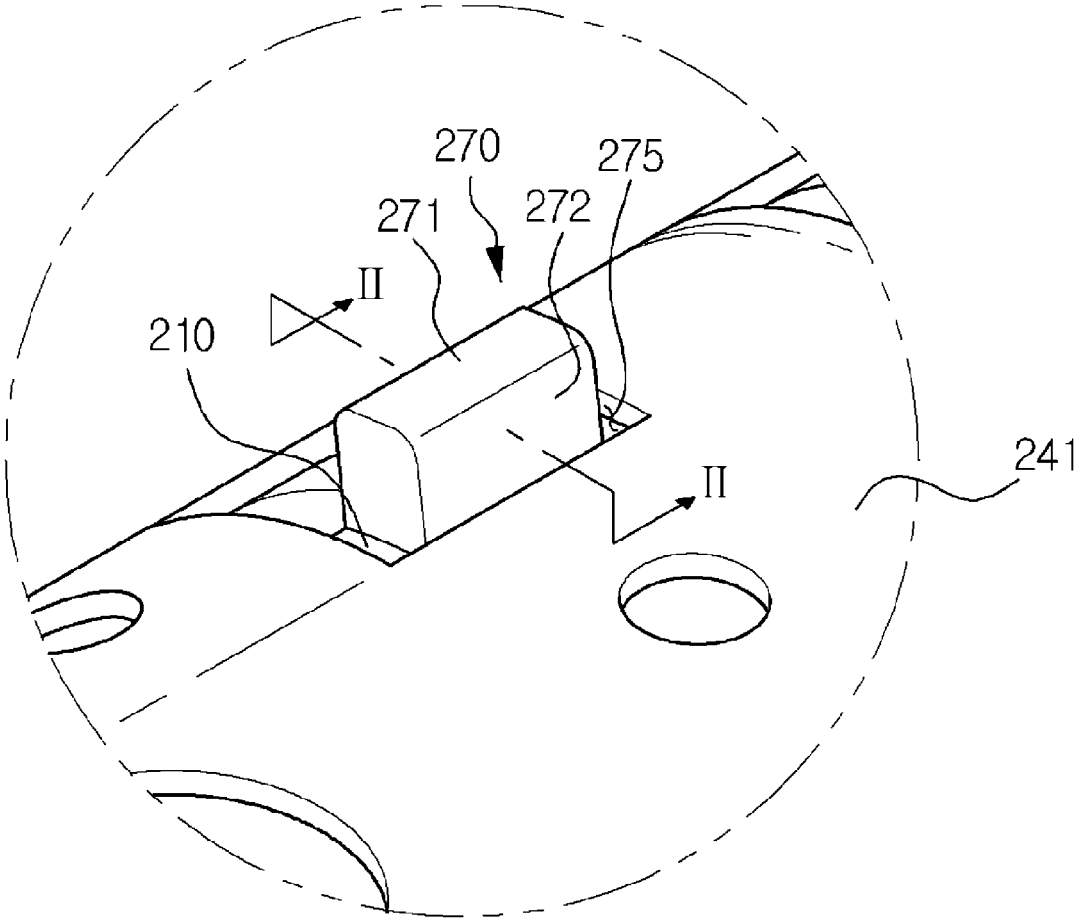
FIG. 9 is an enlarged view illustrating a second power-transmission structure illustrated in FIG. 4.
Figure 10:
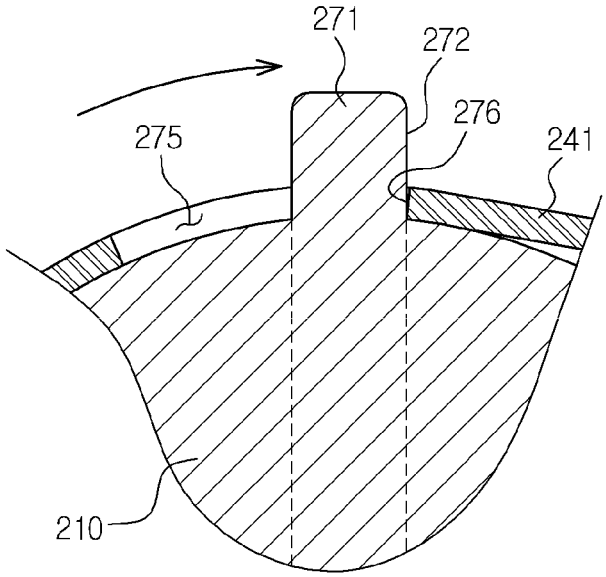
FIG. 10 is a sectional view taken along the line II-II of FIG. 9.

FIG. 9 is an enlarged view illustrating the second power-transmission structure illustrated in FIG. 4, and FIG. 10 is a sectional view taken along the line II-II of FIG. 9.

As illustrated in FIGS. 4, 9, and 10, the second power-transmission structure 270 can include a plurality of first coupling protrusions 271 formed at the outer peripheral surface of the first rotating member 210, and a plurality of first coupling holes 275 formed in the second developer delivery belt 241 to receive the plurality of first coupling protrusions 271. The plurality of first coupling protrusions 271 can be arranged in the circumferential direction of the first rotating member 210, and the plurality of first coupling holes 275 can be arranged in a rotating direction of the second developer delivery belt 241.

The first coupling protrusions 271 of the first rotating member 210 can be inserted into the first coupling holes 275 as the first rotating member 210 is rotated so as to transmit rotation power to the second developer delivery belt 241. The first coupling protrusions 271 of the first rotating member 210 minimize the separation from the first coupling holes 275 after being inserted into the first coupling holes 275 at least during transmission of power.

One or more of the first coupling holes 275 can have a contact portion 276 to come into contact with the first coupling protrusion 271 inserted thereinto, and one or more of the first coupling protrusions 271 can have a holding surface 272 opposite to the contact portion 276 of the first coupling hole 275. The holding surface 272 of the first coupling protrusion 271 has a height in a radial direction of the first rotating member 210 so as to minimize and/or prevent the first coupling protrusion 271 from being separated from the first coupling hole 275 of the second developer delivery belt 241 during transmission of power.

Figure 11:
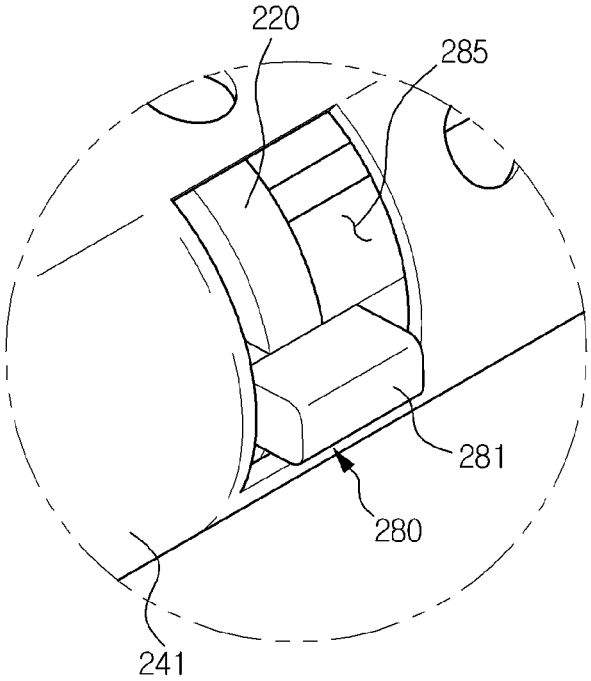
FIG. 11 is an enlarged view illustrating a third power-transmission structure illustrated in FIG. 4.

FIG. 11 is an enlarged view illustrating a third power-transmission structure illustrated in FIG. 4. As illustrated in FIGS. 4 and 11, the second developer delivery belt 241 can be connected to the second rotating member 220 via a third power-transmission structure 280. The third power-transmission structure 280 can transmit rotation power of the second developer delivery belt 241 to the second rotating member 220 such that the second rotating member 220 can be rotated together with the first rotating member 210.

The third power-transmission structure 280 can include a plurality of second coupling protrusions 281 formed at an outer peripheral surface of the second rotating member 220, the second coupling protrusions 281 arranged in a circumferential direction of the second rotating member 220, and a plurality of second coupling holes 285 formed in the second developer delivery belt 241 to receive the plurality of second coupling protrusions 281, the second coupling holes 285 arranged in a rotating direction of the second developer delivery belt 241.

The second coupling protrusions 281 of the second rotating member 220 can be inserted into the second coupling holes 285 as the second developer delivery belt 241 is rotated, so as to receive rotation power transmitted from the second rotating member 220. The second coupling protrusions 281 of the second rotating member 220 can a height in a radial direction of the second rotating member 220 so as to minimize and/or prevent the second coupling holes 285 of the second developer delivery belt 241 from being separated from the second coupling protrusions 281 during transmission of power.

Referring to FIG. 4, the developer delivery belts 231, 241 and 251 may include a plurality of delivery protrusions 233, 243 and 253 and openings 235, 245 and 255. The delivery protrusions 233, 243 and 253 can protrude from the developer delivery belts 231, 241 and 251, so as to supply and return of the developer. The openings 235, 245 and 255 can supply and return the developer, prevent the developer delivery belts 231, 241 and 251 from applying excessive stress to the developer, and educe and/or minimize a drive torque of the developer delivery belts 231, 241 and 251.

As illustrated in FIGS. 2 and 3, the developing device 40Y may include press members 300 arranged in the first developer storage unit 102 to press outer surfaces of the developer delivery belts 231, 241 and 251. The press members 300 can provide the developer delivery belts 231, 241 and 251 with tension to improve operation reliability of the developer delivery belts 231, 241 and 251.

The press members 300 may be press ribs 310, 320 and 330 that protrude from a lower surface of the cover 120 that covers the first developer storage unit 102. The press ribs 310, 320 and 330 can be arranged to correspond to the developer delivery belts 231, 241 and 251, respectively.

By adjusting a protruding height of the press rib 310 to press the first developer delivery belt 231, a slip initiation time can be adjusted between the first rotating member 210 and the first developer delivery belt 231. For example, when the press rib 310 has an increased protruding height, a tension acts on the first developer delivery belt 231, thereby minimizing and/or restricting slip between the first rotating member 210 and the first developer delivery belt 231. Slip may occur when a load that is greater than or equal to a predetermined value is applied to the first developer delivery belt 231 due to the clumped developer. When the press rib 310 has a reduced protruding height, slip between the first rotating member 210 and the first developer delivery belt 231 may occur when a load that is lower than a predetermined value acts on the first developer delivery belt 231.

By adjusting a protruding height of the press rib 330 to press the third developer delivery belt 251, a slip initiation time between the first rotating member 210 and the third developer delivery belt 251 may be adjusted.

Although FIGS. 2 and 3 illustrate the press member in the form of a rib, a roller-shaped press member or any other suitably shaped member may be employed to carry out the exemplary embodiments of the present general inventive concept as described herein.

Hereinafter, an operation of the developer delivery device 200 will be described with reference to FIGS. 2 to 6.

The developer received in the first developer storage unit 102 may be lopsided toward the first developer delivery belt 231, and may be clumped during conveyance or handling of the developing device 40Y.

When the developing device 40Y is mounted into the body 10 and is operated under this situation, a load that is greater than or equal to a threshold load value can act on the first developer delivery belt 231 due to the clumped developer, and the receiving holes 265 of the first developer delivery belt 231 can slip on the slip guide portions 262 rather than being engaged and rotated with the protrusions 261 of the first rotating member 210. Thereby, the first developer delivery belt 231 may not be rotated if the first rotating member 210 is rotated. This may minimize and/or prevent damage to or deformation of elements caused when the first developer delivery belt 231 is driven even when the load is greater than or equal to the threshold load value.

The second developer delivery belt 241 may be an intermediate developer delivery belt that receives rotation power via the second power-transmission structure 270, and may be rotated together with the first rotating member 210 to deliver the developer. As an opposite side of the first developer delivery belt 231 may be less affected by the load due to the clumped developer, the third developer delivery belt 251 can be rotated together with the first rotating member 210 upon receiving rotation power transmitted via the first power-transmission structure 260.

As the developer is delivered via rotation of the second developer delivery belt 241 and the third developer delivery belt 251, the clumped developer around the first developer delivery belt 231 can become more fluid, thereby spreading toward the second developer delivery belt 241 and the third developer delivery belt 251.

Less load may act on the first developer delivery belt 231 such that the protrusions 261 of the first rotating member 210 may be inserted into the receiving holes 265 of the first developer delivery belt 231 at a predetermined time and may enable the transmission of power. Thereby, the first developer delivery belt 231 can be rotated so as to deliver the developer.

When the developer is lopsided toward the third developer delivery belt 251, damage to elements may be minimized and/or prevented via an operation similar to the above-described operation.

Although the above-described embodiments illustrate example wherein three developer delivery members can be used, the number of the developer delivery members may be changed (e.g., greater than or less than three developer delivery members). For example, two developer delivery members or four or more developer delivery members may be employed.

As is apparent from the above description, according to the exemplary embodiments of the present general inventive concept, damage to or deformation of constituent elements of a developer delivery device may be minimized and/or prevented due to load acting thereon.

As a delivery member of the developer delivery device may perform smooth delivery of developer even if a load that is greater than or equal to acts on the developer delivery device, deterioration in image quality due to defective developer supply can be minimized and/or presented.

Although several embodiments have been illustrated and described, it would be appreciated by those skilled in the art that changes may be made in these embodiments without departing from the principles and spirit of the invention, the scope of which is defined in the claims and their equivalents.

What is claimed is:

1. A developing device usable with an image forming apparatus, the developing device comprising:

a developer storage unit;

a first rotating member arranged in the developer storage unit;

a plurality of developer delivery members arranged in an axial direction of the first rotating member to be rotated around the first rotating member upon receiving rotation power from the first rotating member; and a first power-transmission structure to connect at least one of the plurality of developer delivery members and the first rotating member to each other, such that there is slip between the at least one of the plurality of developer delivery members and the first rotating member, the first power-transmission structure including:

at least one protrusion to protrude from one of the at least one of the plurality of developer delivery members and the first rotating member; and at least one receiving hole formed in the other one of the at least one of the plurality of developer delivery members and the first rotating member, so as to receive the protrusion, wherein the at least one protrusion includes a slip guide portion formed at a surface thereof to guide the slip between the receiving hole and the protrusion.

2. The developing device according to claim 1, wherein the slip guide portion includes at least one of a curved surface and an inclined surface.

3. The developing device according to claim 1, wherein the at least one receiving hole includes a contact portion to contact the slip guide portion and at least one slit extending from an end of the contact portion.

4. The developing device according to claim 1, further comprising:

at least one press member arranged in the developer storage unit to press an outer surface of at least one of the plurality of developer delivery members.

5. The developing device according to claim 1, further comprising:

a second power-transmission structure to connect at least one of the plurality of developer delivery members and the first rotating member to each other such that the at least one of the plurality of developer delivery members is engaged and rotated with the first rotating member.

6. A developing device usable with an image forming apparatus, the developing device comprising:

a developer storage unit;

a first rotating member arranged in the developer storage unit;

a plurality of developer delivery members arranged in an axial direction of the first rotating member to be rotated around the first rotating member upon receiving rotation power from the first rotating member, the plurality of developer delivery members including:

a first developer delivery member and a third developer delivery member arranged at opposite sides of the first rotating member in the axial direction; and a second developer delivery member arranged between the first developer delivery member and the third developer delivery member, wherein at least one of the first developer delivery member and the third developer delivery member is movable relative to the second developer delivery member.

7. The developing device according to claim 6, further comprising:

a second rotating member arranged opposite the first rotating member to rotatably support the plurality of developer delivery members; and a power-transmission structure to transmit rotation power of the second developer delivery member to the second rotating member.

8. The developing device according to claim 7, wherein the third power-transmission structure includes:

at least one coupling protrusion to protrude from the second rotating member; and a plurality of coupling holes formed in the second developer delivery member in a rotating direction of the second developer delivery member.

9. A developing device usable with an image forming apparatus, the developing device comprising:

a housing having a developer storage unit defined therein;

a first rotating member and a second rotating member arranged in the developer storage unit; and a first, second, and third developer delivery belts arranged in an axial direction of the first rotating member and rotatably supported by the first rotating member and the second rotating member, wherein at least one of the first, second, and third developer delivery belts is rotatable relative to the first rotating member.

10. The developing device according to claim 9, wherein the first developer delivery belt and the third developer delivery belt are arranged at opposite ends of the first rotating member in the axial direction, and are rotatable relative to the first rotating member.

11. The developing device according to claim 10, wherein the second developer delivery belt is arranged between the first developer delivery belt and the third developer delivery belt and connects the first rotating member and the second rotating member to each other such that the second rotating member is rotated by the rotation of the first rotating member.

12. The developing device according to claim 9, wherein the housing includes at least one press rib protruding inward of the developer storage unit to press an outer surface of at least one of the first to third developer delivery belts.

13. A developing device usable with an image forming apparatus, comprising:

a developer storage unit to store developer therein and having a predetermined width;

a plurality of developer delivery members adjacent to each other and extending along the predetermined width within the developer storage unit;

a drive member to drive the plurality of developer delivery members to deliver developer along a lengthwise direction of a developed receiving chamber;

a plurality of protrusions formed on an outer surface of the drive member; and a plurality of receiving holes formed on the plurality of developer delivery members to receive the plurality of protrusions.

14. The developing device of claim 13, wherein the drive member comprises:

a first rotating member to rotate the plurality of developer delivery members to deliver the developer; and a second rotating member to support the plurality of developer delivery members and rotate together with the first rotating member.

15. The developing device of claim 14, wherein the drive member allows slip between at least one of the first and second rotating members and the plurality of developer delivery members.

16. The developing device of claim 13, wherein at least one of the plurality of protrusions includes a slip guide portion.

17. The developing device of claim 16, wherein the slip guide portion includes a surface that is convexly curved or inclined.

18. The developing device of claim 13, wherein the plurality of receiving holes comprise:

a contact portion to contact at least one of the plurality of developer delivery members that is received; and a slit portion to deform the contact portion when the at least one of the plurality of developer delivery members is received and contacts the contacting portion.

* * * * *